US009468311B2

(12) United States Patent
Sekela et al.

(10) Patent No.: US 9,468,311 B2
(45) Date of Patent: Oct. 18, 2016

(54) SONIC WELDED OPTIC ASSEMBLY

(75) Inventors: William David Sekela, Aurora, OH (US); Mathew Sommers, Sagamore Hills, OH (US); Mark Kaminski, Tucson, AZ (US); Todd Cassidy, Medina, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 1298 days.

(21) Appl. No.: 12/913,223

(22) Filed: Oct. 27, 2010

(65) Prior Publication Data

US 2011/0096551 A1 Apr. 28, 2011

Related U.S. Application Data

(60) Provisional application No. 61/255,287, filed on Oct. 27, 2009.

(51) Int. Cl.

| | |
|---|---|
| ***A47F 3/00*** | (2006.01) |
| ***F21V 5/04*** | (2006.01) |
| ***F21V 7/00*** | (2006.01) |
| *F21V 5/08* | (2006.01) |
| *F21W 131/305* | (2006.01) |
| *F21W 131/405* | (2006.01) |
| *F21Y 101/02* | (2006.01) |

(52) U.S. Cl.

CPC ..... *A47F 3/001* (2013.01); *F21S 4/20* (2016.01); *F21V 5/04* (2013.01); *F21V 7/0091* (2013.01); *F21V 5/08* (2013.01); *F21W 2131/305* (2013.01); *F21W 2131/405* (2013.01); *F21Y 2101/02* (2013.01)

(58) Field of Classification Search

CPC ..... F21Y 2101/02; F21Y 2105/003; F21Y 2105/001; F21Y 2103/003; F21Y 2113/00; F21Y 2103/022; F21Y 2111/002; F21Y 2105/00; F21Y 2105/005; F21Y 2111/004; F21Y 2111/008; F21Y 2113/005; F21Y 2113/02; F21K 9/135; F21K 9/30; F21K 9/52; F21K 9/10; F21K 9/13; F21K 9/50; F21K 9/56; F21V 5/04; F21V 7/0008; F21V 19/001; F21V 19/006; F21V 29/004; F21V 29/74; F21V 7/00; F21V 15/01; F21V 2200/30; F21V 29/75; F21V 7/22; F21V 9/16; F21V 13/02; F21V 13/08; F21V 23/06; F21V 29/763; F21V 29/773; F21V 29/83; F21V 13/04; F21V 23/005; F21V 23/02; F21V 23/0457; F21V 23/0471; F21V 29/02; F21V 29/70; F21V 29/80; F21V 29/81; F21V 5/007; F21V 5/048; F21V 11/14; F21V 17/12; F21V 17/164; F21V 19/003; F21V 19/0035; F21V 19/004; F21V 19/0055; F21V 21/002; F21V 23/001; F21V 23/003; F21V 23/007; F21V 23/023; F21V 23/04; F21V 29/002; F21V 29/20; F21V 29/505; F21V 29/506; F21V 29/507; F21V 29/51; F21V 29/713; F21V 29/76; F21V 31/005; F21V 33/0044; F21V 3/02; F21V 3/0472; F21V 3/049; F21S 48/215; F21S 48/11; F21S 48/1109; F21S 48/1154; F21S 48/1195; F21S 48/12; F21S 48/13; F21S 48/1317; F21S 48/1358; F21S 48/137; F21S 48/1376; F21S 48/1747; F21S 48/212; F21S 48/2287; F21S 48/2293; F21S 48/234; F21S 4/006; F21S 4/008; F21S 8/00; F21S 8/033; F21S 8/046; F21S 8/088; F21W 2131/103; F21W 2131/305; F21W 2131/405; F21W 2111/00; F21W 2111/02; F21W 2131/105; F21W 2131/107

USPC ..... 362/296.01, 310, 311.02, 125, 217.02, 362/217.15, 225, 218, 221, 217.04, 217.05, 362/249.02

See application file for complete search history.

(56) References Cited

U.S. PATENT DOCUMENTS

| | | | | |
|---|---|---|---|---|
| 6,598,998 | B2 * | 7/2003 | West et al. | 362/307 |
| 7,021,797 | B2 * | 4/2006 | Miñano et al. | 362/355 |
| 8,197,105 | B2 * | 6/2012 | Yang | 362/346 |
| 2003/0165061 | A1 * | 9/2003 | Martineau | 362/297 |
| 2008/0049438 | A1 * | 2/2008 | Bloemen et al. | 362/540 |

* cited by examiner

*Primary Examiner* — Stephen F Husar
*Assistant Examiner* — Danielle Allen
(74) *Attorney, Agent, or Firm* — Fay Sharpe LLP

(57) ABSTRACT

An optic assembly includes a light source, a reflector to reflect light emitted by the light source, and an optical lens disposed over and/or around the light source. The optical lens is configured to direct light emitted from the light source using refraction and total internal reflection.

18 Claims, 6 Drawing Sheets

SONIC WELDED OPTIC ASSEMBLY

CROSS-REFERENCE TO RELATED APPLICATION

This application claims the benefit of U.S. Provisional Application No. 61/255,287, filed Oct. 27, 2009, incorporated herein by reference in its entirety.

BACKGROUND

The present exemplary embodiments relate generally to lighting assemblies. They find particular application in conjunction with lighting display cases (e.g., commercial refrigerated display cases), and will be described with particular reference thereto. However, it is to be appreciated that the present exemplary embodiments are also amenable to other like applications.

Lighting assemblies are used to illuminate display cases, such as commercial refrigeration display cases, as well as other display cases that need not be refrigerated. Typically lighting assemblies use a fluorescent tube to illuminate products disposed in a display case. However, fluorescent tubes are being phased out in favor of LED technology.

Fluorescent tubes do not have nearly as long a lifetime as typical LED, and, for at least refrigerated display cases, initiating the required arc to illuminate a fluorescent tube is difficult. Even more, fluorescent tubes are relatively inefficient by comparison to LEDs, since fluorescent tubes produce more heat than LEDs and provide less control over the direction of light.

Known lighting assemblies often suffer from a number of problems when it comes to lighting display cases. As discussed below, these problems may include issues pertaining to efficiency, lighting uniformity, consumer appeal, customization and maintenance.

Lighting assemblies often allow light to escape the display case and bleed out into the external environment. However, this light could be put to better use lighting the item(s) on display, whereby less powerful and/or or fewer light sources could be employed.

Further, lighting assemblies generally do not uniformly light a display case. Namely, such assemblies generally fail to direct enough light to the center of a display case, resulting in much higher luminance in front of a mullion, as compared to the center of the display case. However, uniform luminance is preferable as it makes more efficient use of the available luminance and may allow fewer light sources and/or less powerful light sources.

Additionally, the optics and/or light sources of lighting assemblies are often visible to consumers. However, consumer tests have found it desirable to keep optics and/or light sources of a lighting assembly outside the view of an onlooker of the display case.

Even more, existing lighting assemblies are generally constructed with a fixed configuration in mind, whereby changing the configuration requires a mechanical and/or electrical redesign. However, this can add unnecessary expense when unconventional configurations are needed.

Further, existing lighting assemblies generally lack any way to replace components. When a component fails, the entire lighting assembly generally needs to be replaced. This can prove costly for one operating a large number of light assemblies.

The present disclosure contemplates new and improved systems and/or methods addressing these, and other, problems.

BRIEF DESCRIPTION

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to one aspect of the present disclosure, an optic assembly is provided. The optic assembly includes a light source, a reflector to reflect light emitted by the light source, and an optical lens disposed over and/or around the light source. The optical lens is configured to direct light emitted from the light source using refraction and total internal reflection.

According to another aspect of the present disclosure, an optic assembly is provided. The optic assembly includes a light source, and an optical lens disposed over and/or around the light source. The optical lens is disposed exclusively within the visibility envelope and is fashioned to control light emitted from the light source using refraction and total internal reflection.

According to another aspect of the present disclosure, an optic assembly is provided. The optic assembly includes a light source, a reflector to reflect light emitted by the light source, and an optical lens disposed over and/or around the light source. The optical lens is disposed to refract a first portion of the light emitted from the light source immediately through a first surface and totally reflect a second portion of light source emitted from the light source immediately off a second surface.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
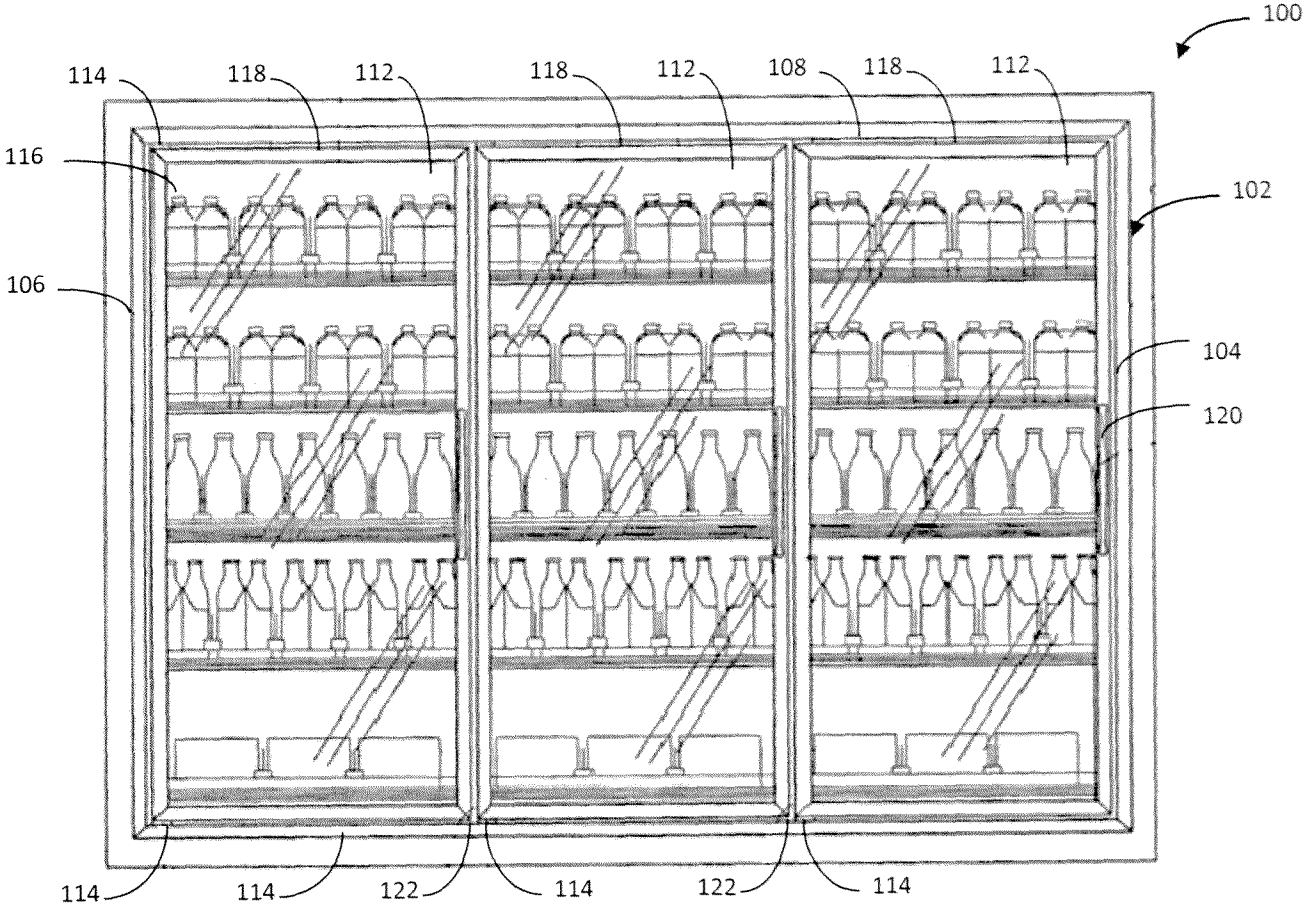
FIG. 1 is a plan view of a commercial refrigeration display case.

One or more embodiments or implementations are hereinafter described in conjunction with the drawings, where like reference numerals are used to refer to like elements throughout, and where the various features are not necessarily drawn to scale.

With reference to FIG. 1, a typical refrigerated display case 100 is illustrated. The refrigerated display case 100 has a door and frame assembly 102 mounted to a front portion of the case 100. The door and frame assembly 102 includes side frame members 104, 106 and top and bottom frame members 108, 110 that interconnect the side frame members 104, 106. Doors 112 mount to the frame members 104, 106, 108, 110 via hinges 114. The doors 112 include glass panels 116 retained in frames 118 and handles 120 may be provided on the doors. Mullions 122 mount to the top and bottom frame members 108, 110 to provide door stops and points of attachment for the doors 112 and/or hinges 114.

The lighting assemblies disclosed herein may suitably be employed within a display case, such as the refrigerated display case 100, as well as in a multitude of other applications. Further, the display case may employ different configurations than the refrigerated display case 100. For example, the display case may be a refrigerated display case lacking doors. As another example, the display case may be free-standing or a built-in display case.

Figure 2:
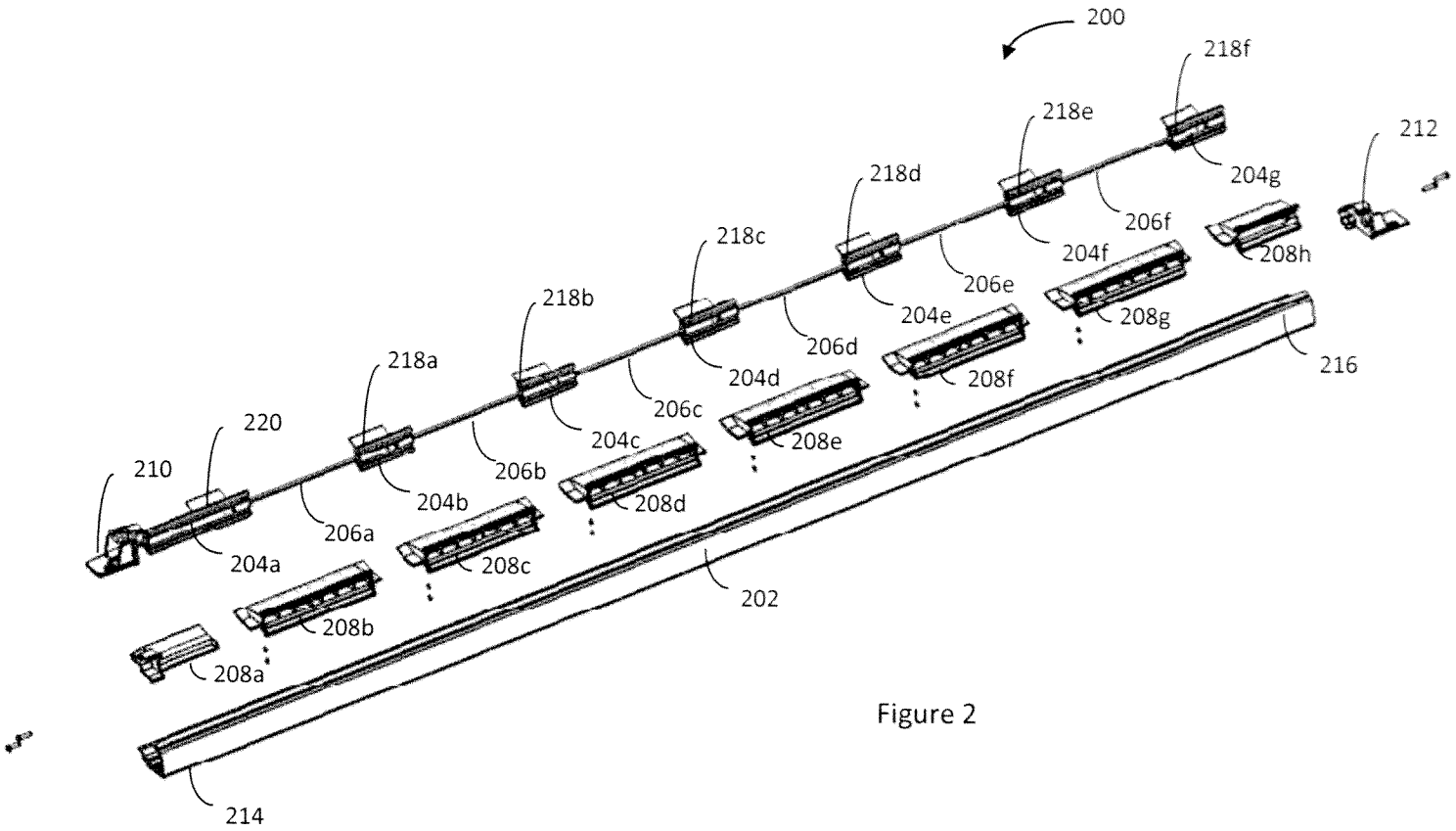
FIG. 2 is an exploded view of a lighting assembly.

With reference to FIG. 2, an exploded view of a lighting assembly 200 is illustrated. The lighting assembly 200 may include an elongated frame 202, one or more modules 204, one or more electrical cables 206, one or more spacers 208, end caps 210, 212, and a cover (not shown). Suitably, the lighting assembly 200 mounts vertically to a standard mullion, such as the mullion 122 depicted in FIG. 1, and therefore may have a width that is substantially equal to a standard mullion.

The frame 202 is suitably L-shaped. Further, the frame 202 substantially defines the lighting assembly 200 and provides a structure on which to secure the modules 204 and/or the spacers 208. The modules 204 and/or the spacers 208 are hereafter referred to as the modular inserts. Suitably, the modular inserts are slidingly secured to the frame 202 via a channel defined by opposing grooves running along the length of the frame 202. In such embodiments, each of the modular inserts includes opposing tabs that interlock with the opposing grooves, thereby limiting the range of motion of the modular inserts to motion along the length of the frame 202. The end caps 210, 212 then prevent the modular inserts from sliding out of the frame 202.

Figure 3:
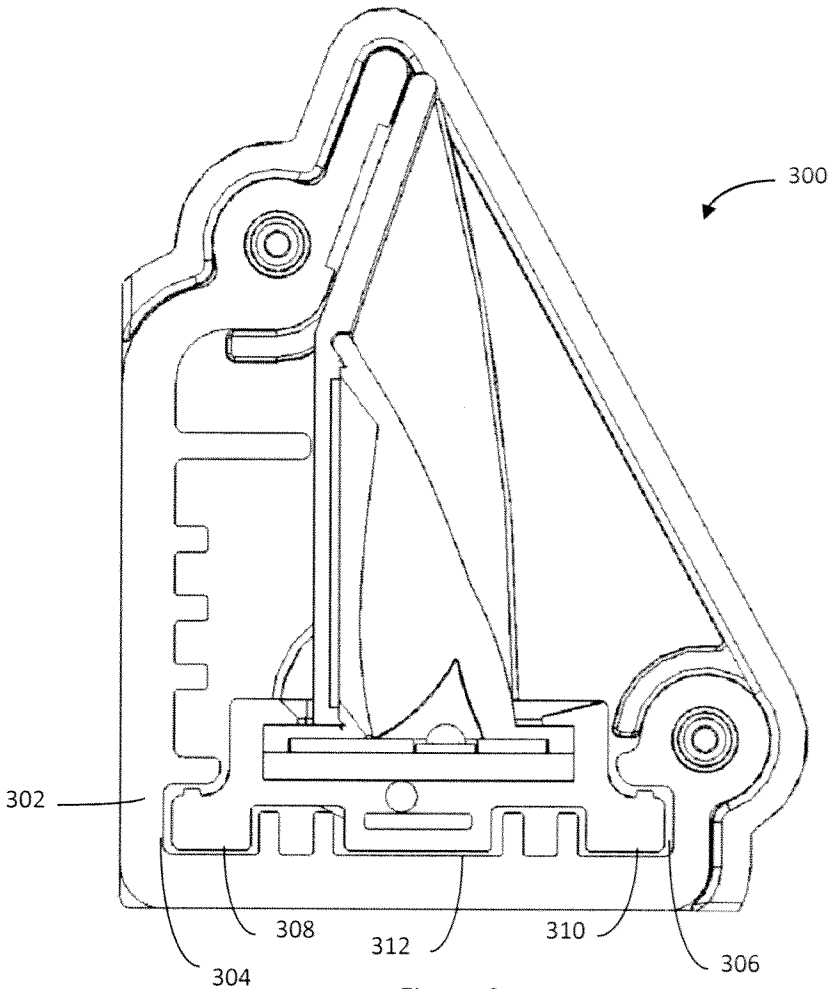
FIG. 3 is a cross sectional view of a lighting assembly.

Referring to FIG. 3, a cross sectional view of a lighting assembly 300 illustrates the interlocking system of grooves and tabs. Therein, a frame 302 of the lighting assembly 300 includes opposing grooves 304, 306 extending along the length of the frame 302. Opposing tabs 308, 310 on a modular insert 312 then interlock with the grooves 304, 306, so as to limit motion of the modular insert 312 to motion along the length of the frame 302.

Referring back to FIG. 2, the frame 202 is preferably comprised of a polymeric material, so as to reduce costs associated with the lighting assembly 200. However, the frame 202 need not necessarily be polymeric, whereby the frame 202 may, for example, be comprised of a thermally conductive material, such as aluminum, so as to act as a heat sink and facilitate the transfer heat away from the lighting assembly 200.

The modules 204 are suitably comprised of a polymeric material, so as to reduce costs associated with the lighting assembly 200, but other materials equally amenable. For example, as with the frame 202, the modules 204 may be comprised of a thermally conductive material, such as aluminum, so as to act as a heat sink and facilitate the transfer heat away from the lighting assembly 200.

So that power may be transferred from one end 214, 216 of the lighting assembly 200 to the other end 214, 216 of the lighting assembly 200, the modules 204 may be interconnected with one or more electrical cables 206. The electrical cables 206 may run through grooves on the modular inserts. Alternatively, the electrical cables 206 may be disposed within the modular inserts. In such embodiments, each modular insert preferably has an electrical cable running therethrough between a pair of connectors, where the connectors of adjacent modular inserts are provisioned to mechanically couple to one another and electrically connect the individual electrical cables.

The modules 204 may include at least one of one or more light modules 218, one or more power modules 220, and the like. The light modules 218 may provide illumination to a display case and may include one or more light sources. Suitably, the light sources include one or more LEDs. The power modules 220 may provide illumination to a display case and/or provide power to the light modules 218. Suitably, the power modules 220 receive power from an external power source and are disposed on the distal ends 214, 216 of the frame 202, so as to easily receive power from the external power source. The power modules 220 may include one or more of a light module, a power regulating circuit, a power conditioning circuit, and the like.

The power regulating circuit regulates the flow of current through the modules 204 so as to allow the lighting assembly 200 to dynamically adapt to an increased load; for example, an additional light module. Preferably, this is accomplished with a simple DC-DC converter, but other means of accomplishing this are equally amenable.

The power conditioning circuit may convert alternating current voltage to a direct current voltage. For example, the power conditioning circuit may convert 120 or 240 volt alternating current voltage to a direct current voltage. The power conditioning circuit may additionally, or alternatively, correct for polarity of the incoming power so that the power supply wires that connect to the power module 220 can be connected without having to worry about which wire connects to which element of the power conditioning circuit.

The spacers 208 serve to orient the modules 204 within the frame 202. Suitably, the spacers 208 alternate with the modules 204 along the length of the frame 202 and have equal lengths so as to equally space the modules 204 and provide a uniform lighting pattern. However, the lengths of spacers 208 may vary from one spacer to another and uniform spacing of the modules 204 is not required. For example, it may be desirable to space the modules 204 closer together in the center of the lighting assembly 200 in order to increase illumination on the center shelves of a display case. In such an example, the spacers disposed in the center of the lighting assembly 200 may have shorter lengths than the spacers disposed at the periphery of the lighting assembly 200.

The spacers 208 are suitably white so as to reflect light away from the spacers 208, but other colors are equally amenable. Further, the spacers 208 are suitably comprised of a polymeric material, so as to reduce costs associated with the lighting assembly 200, but other materials equally amenable. For example, the spacers 208 may be comprised of a thermally conductive material, such as aluminum. In certain embodiments, when the end of a spacer is adjacent to a module, the spacers 208 are shaped as module reflectors to help reflect light away from the lighting assembly. Module reflectors are discussed below.

The end caps 210, 212 are fastened to the distal ends 214, 216 of the frame 202 and serve to secure the modular inserts (i.e., the one or more of the modules 204, the spacers 208 and the reflectors 210) within the frame 202. Additionally, the end caps 210, 212 provide a mounting structure to facilitate attachment of the lighting assembly 200 to a display case. It should be appreciated, however, that the lighting assembly 200 can be mounted to the display case by other means. For example, the frame 202 may be mounted directly to the mullion by way of mechanical means.

Although not shown, the lighting assembly 200 may include a cover that mounts to the frame 202 and includes a clear and/or translucent portion that allows light to pass therethrough. The translucent portion of the cover may be tinted to adjust the color of the light emitted by the lighting assembly 200.

Figure 4:
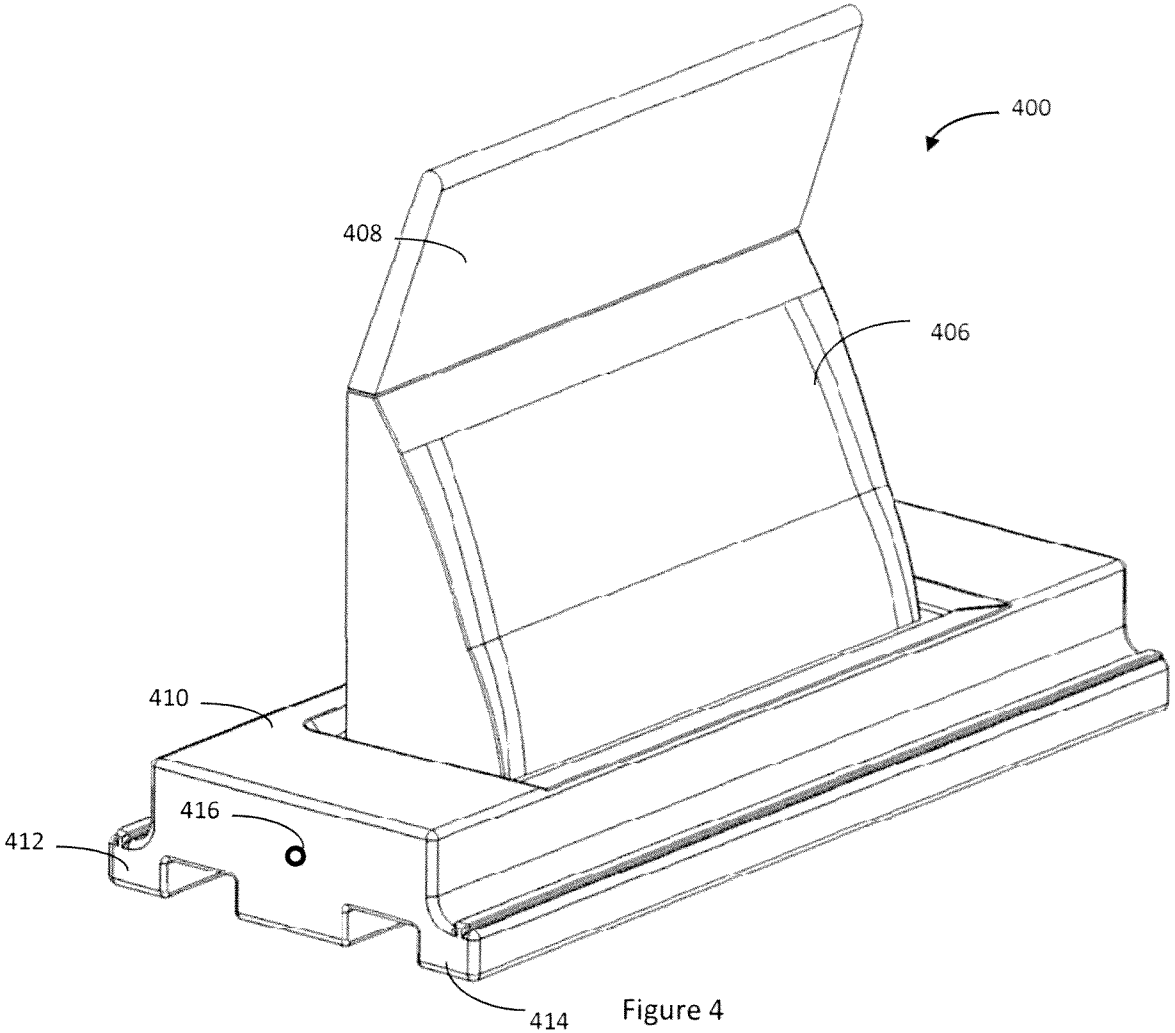
FIG. 4 is a perspective view of a light module.
Figure 5:
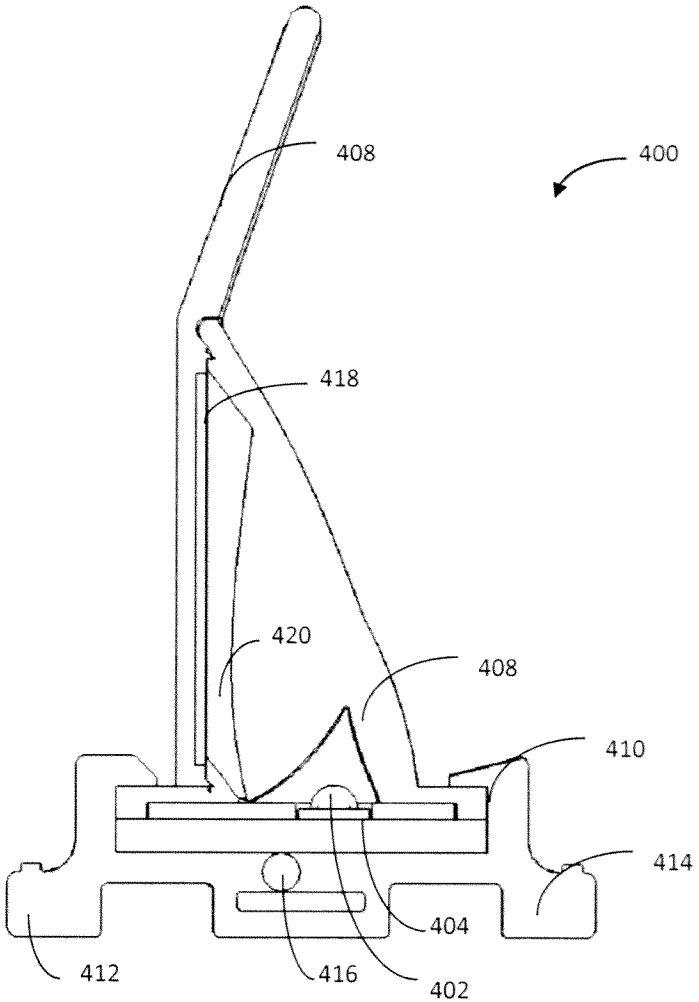
FIG. 5 is a cross sectional view of the light module of FIG. 4.

With reference to FIGS. 4 and 5, a light module 400 is illustrated. FIG. 10 is a perspective view of the light module 400, and FIG. 11 is a cross sectional view of the light module 400. As noted above, light modules provide illumination to a display case and may include one or more light sources, such as LEDs. The light module 400 may include one or more light sources 402, a printed circuit board 404, an optical lens 406, a reflector 408, a housing 410, opposing tabs 412, 414, and a conduit 416.

The light sources 402 provide luminance to the display case employing the lighting assembly associated with the light module 400. Suitably, the light sources include one or more LEDs. The light sources 402 may be selected to control Correlated Color Temperature (CCT), Color Rendering Index (CRI) and other like characteristics of light.

The printed circuit board 404 is disposed within the housing 410 and includes a lower surface opposite an upper surface, where the light sources 402 mount to the upper surface. The printed circuit board 404 may include a metal core printed circuit board ("MCPCB"), but other circuit boards are equally amenable. Further, the printed circuit board 404 may include a rectangular configuration extending along the length of the light module, but other configurations are equally amenable. Suitably, the printed circuit board 404 includes a plurality of traces electrically connecting to the light sources 402 to the electrical power cables interconnecting the modules of the lighting assembly.

The optical lens 406 is disposed over and/or around the light sources 402. Suitably, the optical lens 406 directs light emitted from the light sources 402 such that a majority of the light is emitted to the sides of the optical lens 406. Advantageously, this allows the profile of the lighting assembly to be very thin, thereby precluding a consumer viewing the inside of the display case from seeing the optics and/or the light source. The optic material of the optical lens 406 may be tinted to remove components of the light passing through the optical lens 406. Additionally, the optical lens 406 may include one or more of an anti-fog, an anti-glare, reflective coating and the like.

The reflector 408 reflects light generated by the light sources 402 to the center of the display case. Suitably, the reflector 408 is bonded to the optical lens 406 by means of sonic weld, vibration weld, adhesive, or the like to define an air gap 418. As will be seen, the optical lens makes use of total internal reflection along a boundary 420 abutting this air gap. This bonding seals the air gap 418 and protects the boundary 420 from condensation buildup of any material (e.g., food elements from spills) that would frustrate total internal reflection. This is important because the boundary 420 is not exposed and cannot be cleaned. The air gap 418 also provides for self heating to clean off any residue on the total internal reflector surface. For example, any moisture or condensation that exists on the total internal reflector surface can be cleared off or defrosted by the self heating of the air gap 418 from the light source 402.

So as to facilitate the reflection of light away from the reflector 408, the reflector 408 is suitably white. Further, the reflector 408 is suitably comprised of a polymeric material, so as to reduce the cost and weight of the light module 400. However, the reflector 408 need not necessarily be white and/or formed of a polymeric material. For example, the reflector 408 may alternatively be formed of a thermally conductive material, such as aluminum.

The housing 410 holds the optical lens 406, the printed circuit board 404, and the reflector 408 together. To accomplish this, the housing 410 suitably includes a plastic over mold. However, other means of securing the optical lens 406, the printed circuit board 404, and the reflector 408 to the housing 410 are equally amenable. For example, the optical lens 406, the printed circuit board 404, and the reflector 408 may be secured to the housing via tape, glue, mechanical fastener or the like. So as to reduce its visibility to an onlooker of the display case, the housing 410 is suitably black. Further, as with the reflector 408, the housing 410 is suitably comprised of a polymeric material, so as to reduce the cost and weight of the light module 400.

The opposing tabs 412, 414 allow the light module 400 to be slidingly secured to the frame of a lighting assembly. Namely, as discussed above, the opposing tabs 412, 414 fit within grooves of the frame of the lighting assembly, thereby limiting motion of the light module 400 to motion along the length of the lighting assembly.

The conduit 416 is disposed within the housing 410 and extends along its length thereby providing a channel within which to place the electrical cables interconnecting modules. Suitably, the conduit 416 is large enough to receive one or more electrical cables interconnecting the modules of the lighting assembly. As noted above, the printed circuit board 404 is electrically coupled to the electrical cables so as to provide power to the light source 402.

Figure 6:
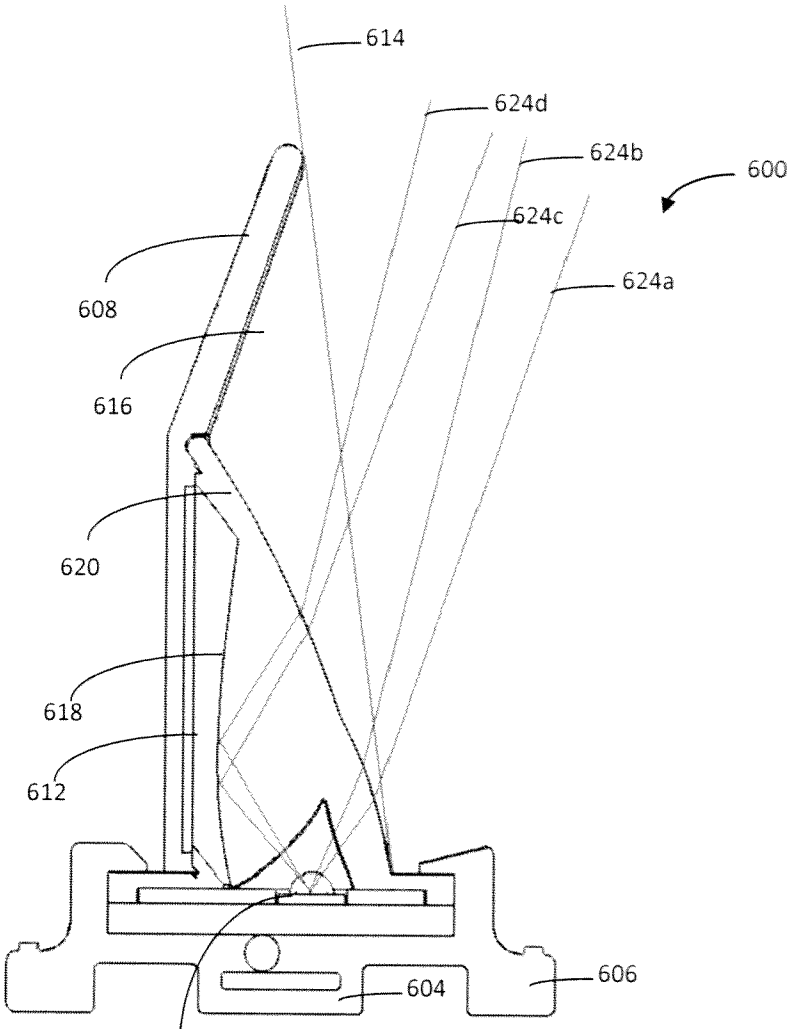
FIG. 6 is a cross sectional view of a light module.

With reference to FIG. 6, an optical lens 602 of a light module 604 is illustrated using a cross sectional view of the light module 604. The light module 604, in addition to including the optical lens 602, includes a housing 606, a reflector 608 and a light source 610 encompassed by the optical lens 602, where there is an air gap 612 between the light source 610 and the optical lens 602.

As shown, a visibility line 614 extends from the optical lens 602 to the periphery of the light module 604. The visibility line 614 defines a region 616 outside the view of a consumer looking in to the display case. This region 616 is hereinafter referred to as the visibility envelope. Consumer tests have shown that it is desirable to keep the optical lens 602 and the light source 610 within the visibility envelope 616. In certain embodiments, the housing 606, which generally falls outside the visibility envelopment 616, is black so as to make it less visible, whereas the reflector 120, which falls within the visibility envelope 616, is suitably white.

So as to ensure the optical lens 602 and the light source 610 are within the visibility envelope 616, the light source 610 and the optical lens 602 are recessed within the light module 604. As should be appreciated, the reflector 608 of the light module 604 helps defines the recess. While recessing the light source 610 and the optical lens 602 helps keep the light source 610 and the optical lens 602 in the visibility envelope 616, it also makes it more difficult to direct the light emitted from the light source 610 to the center of the display case.

The optical lens 602 addresses this difficulty by making use of a combination of total internal reflection and refraction. Most of the light given off by the light source 610 is originally directed to a first boundary 618. This light reflects off the first boundary 618 and then refracts towards the center of the display case via a second boundary 620, as shown by light rays 622. The remaining light given off by the light source 610 is originally directed to the second boundary 620 and refracts to the display case, as shown by light rays 624. For example, the optical lens refracts a first portion of the light emitted from the light source immediately through the second boundary and totally reflects a second portion of light source emitted from the light source immediately off the first boundary; after totally reflecting off the first boundary, the second portion of light refracts through the second boundary. This light is spread from close to the light module 604 to close to the center of the display case depending upon where it crosses along the length of the second boundary. For example, the light rays going left (as oriented by FIG. 12) are directed toward the center of the display case while the light rays going up are directed closer to the light module 604.

In view of the foregoing, the optical lens 602 allows the display case to be more uniformly lit than would otherwise be possible. Further, the optical lens 602 does this while at the same time keeping the optical lens 602 and the light source 610 within the visibility envelope 616, which, as noted above, consumers test have found desirable to consumers.

The lighting assemblies have been described with reference to the disclosed embodiments. Furthermore, components that are described as a part of one embodiment can be used with other embodiment. The invention is not limited to only the embodiments described above. Instead, the invention is defined by the appended claims and the equivalents thereof.

The invention claimed is:

1. An optic assembly comprising:

a printed circuit board;

a light source mounted to the printed circuit board;

a reflector to reflect light emitted by the light source, the reflector being bonded to an optical lens;

the optical lens disposed over and around the light source and configured to direct a majority of light emitted from the light source to the sides of the optical lens;

wherein the optical lens is configured to direct light emitted from the light source using refraction and total internal reflection and the reflector and optical lens are configured to define a cavity between the reflector and the optical lens; and wherein a boundary is formed on the optical lens adjacent the cavity which provides a total internal reflective surface on said optical lens, said boundary existing on only one side of said optical lens.

2. The optic assembly of claim 1, wherein the reflector is bonded to the optical lens by means of a sonic weld.

3. The optic assembly of claim 1, wherein the cavity is sealed and provides for self heating to clean off any residue on the total internal reflective surface.

4. The optic assembly of claim 1, wherein the light source is a light emitting diode (LED).

5. A luminaire optical system comprising:

a housing;

a light source mounted to a printed circuit board disposed within the housing;

an optical lens disposed over and around the light source and configured to direct a majority of light emitted from the light source to only one side of the optical lens;

a reflector to reflect light emitted by the light source, the reflector being bonded to the optical lens;

wherein the housing holds the optical lens, the printed circuit board, and the reflector together, the optical lens is disposed exclusively within the visibility envelope, wherein the optical lens is fashioned to control light emitted from the light source using refraction and total internal reflection, the optical lens is recessed within a housing and light emitted from the light source is reflected off the reflector to light an area proximate the housing, and the reflector and optical lens are configured to define a cavity between the reflector and the optical lens.

6. The optic assembly of claim 5, wherein light emitted from the light source is directed substantially perpendicular to a normal of a base upon which the light source rests.

7. The optic assembly of claim 5, wherein the light source is a light emitting diode (LED).

8. The optic assembly of claim 5, wherein the optical lens defines a cavity between the light source and the optical lens.

9. An optic assembly comprising:

a printed circuit board;

a light source mounted to the printed circuit board;

a reflector to reflect light emitted by the light source, the reflector being bonded to an optical lens;

the optical lens disposed over and around the light source and configured to direct a majority of direct light emitted from the light source to the sides of the optical lens, wherein the optical lens is disposed to refract a first portion of the light emitted from the light source immediately through a first surface and totally reflect a second portion of light source emitted from the light source immediately off a second surface and the reflector and optical lens are configured to define a cavity between the reflector and the optical lens; and wherein a boundary is formed on the optical lens adjacent the cavity which provides a total internal reflective surface on said optical lens, said boundary existing on only one side of said optical lens.

10. The optic assembly of claim 9, wherein after totally reflecting off the second surface, the second portion of light refracts through the first surface.

11. The optic assembly of claim 9, wherein the first surface is the optical lens.

12. The optic assembly of claim 9, wherein the second surface is a total internal reflective surface.

13. The optic assembly of claim 9, wherein the reflector is bonded to the optical lens by means of a sonic weld.

14. The optic assembly of claim 9, wherein the cavity is sealed and provides for self heating to clean off any residue on the total internal reflective surface.

15. The optic assembly of claim 9, wherein the light source is a light emitting diode (LED).

16. An optic assembly comprising:

a light source;

a reflector to reflect light emitted by the light source; and an optical lens disposed over and around the light source and configured to direct a majority of light emitted from the light source to only one side of the optical lens;

wherein the optical lens is configured to direct light emitted from the light source using refraction and total internal reflection, the reflector and optical lens are configured to define a cavity between the reflector and the optical lens, a boundary of the cavity includes a total internal reflective surface, the reflector is bonded to the optical lens by means of a sonic weld, and the cavity is sealed and provides for self heating to clean off any residue on the total internal reflective surface.

17. The optic assembly of claim 1, wherein said reflector is bonded to an end of said lens which is remote from said light source and wherein the only reflective surface of said reflector extends beyond the end of the lens.

18. The optic assembly of claim 5, wherein said reflector is bonded to an end of said lens which is remote from said light source and wherein the only reflective surface of said reflector extends beyond the end of the lens.

* * * * *